US005960946A

United States Patent [19]

Gramlich

[11] Patent Number: 5,960,946

[45] Date of Patent: Oct. 5, 1999

[54] WET PAINT AND ROLLER STORAGE UNIT

[76] Inventor: Gary D. Gramlich, 626 Foothill Dr., Pacifica, Calif. 94404

[21] Appl. No.: 08/946,082

[22] Filed: Oct. 7, 1997

[51] Int. Cl.[6] ..... B65D 81/24

[52] U.S. Cl. ..... 206/209; 206/15.3; 220/326

[58] Field of Search ..... 206/205, 207–209, 206/15.2, 15.3, 361, 352, 805, 225, 229; 220/326, 344

[56] References Cited

U.S. PATENT DOCUMENTS

| | | | |
|---|---|---|---|
| 799,747 | 9/1905 | Martin | 206/15.3 |
| 2,610,731 | 9/1952 | Austin | 206/209 |
| 2,646,808 | 7/1953 | Yenne | 206/209 |
| 2,782,909 | 2/1957 | McNamara . | |
| 2,936,878 | 5/1960 | Claude | 206/209 |
| 2,945,251 | 7/1960 | Eichner | 206/209 |
| 3,666,134 | 5/1972 | Rauch | 220/344 |
| 3,918,582 | 11/1975 | Wallace . | |
| 4,541,542 | 9/1985 | Florentino | 206/361 |
| 4,802,576 | 2/1989 | Kern | 206/361 |
| 5,074,098 | 12/1991 | Filipchuk . | |
| 5,118,001 | 6/1992 | Gambill | 220/344 |
| 5,316,137 | 5/1994 | Kyllonen . | |
| 5,645,164 | 7/1997 | Hocking | 206/209 |

*Primary Examiner*—Paul T. Sewell
*Assistant Examiner*—Luan K. Bui
*Attorney, Agent, or Firm*—Joseph H. McGlynn

[57] ABSTRACT

A tray and lid for storing unused paint and/or wet paint rollers. The tray has a plurality of pivot points which mount a lid to one end of the tray. The tray has snap latches at the sides for securing the lid to the tray in an air tight manner, and in addition a resilient seal is provided between the tray and the lid and extends around the perimeter of the tray.

7 Claims, 1 Drawing Sheet

WET PAINT AND ROLLER STORAGE UNIT

BACKGROUND OF THE INVENTION

This invention relates, in general, to a storage unit, and, in particular, to a storage unit for paint and for a paint roller.

DESCRIPTION OF THE PRIOR ART

In the prior art various types of storage units for unused paint and painting implements have been proposed. For example, U.S. Pat. No. 2,782,909 discloses a storage device for paint brushes which has a container with a lid and a rubber grommet in the lid for holding the brush within the container.

U.S. Pat. No. 3,918,582 discloses a container which stores paint dissolving and cleaning fluids and a means for storing painting implements.

U.S. Pat. No. 5,074,098 discloses a container for storing a wet paint roller.

U.S. Pat. No. 5,316,137 discloses a paint roller tray with a seal for sealing unused paint in the tray.

SUMMARY OF THE INVENTION

The present invention comprises a tray and lid for storing unused paint and/or wet paint rollers. The tray has a plurality of pivot points which mount a lid to one end of the tray. The tray has snap latches at the sides for securing the lid to the tray in an air tight manner, and in addition a resilient seal is provided between the tray and the lid and extends around the perimeter of the tray.

It is an object of the present invention to provide a new and improved storage tray for unused paint and painting implements.

These and other objects and advantages of the present invention will be fully apparent from the following description, when taken in connection with the annexed drawings.

DESCRIPTION OF THE PREFERRED EMBODIMENT

Figure 1:
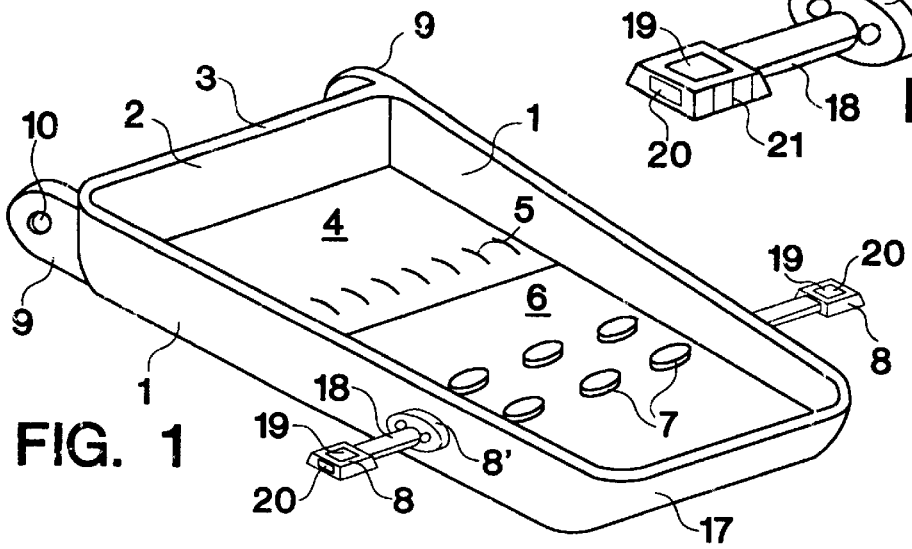
FIG. 1 is a perspective view of the modified paint roller tray of the present invention.
Figure 6:
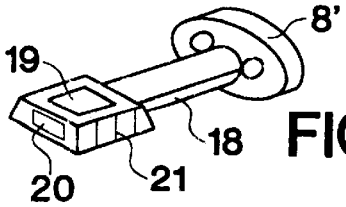
FIG. 6 is a perspective view of the catches used with the present invention.

Referring now to the drawings in greater detail, FIG. 1 shows a modified paint roller tray having sides 1, a back wall 2, a front wall 17 and a two part bottom 4, 6. A sloped surface 5 joins the bottom part 4 with the bottom part 6 so that the portion of the tray that is adjacent the bottom part 4 is deeper than the portion which is adjacent the bottom part 6, as is conventional in the art. The bottom part 6 has a plurality of raised portions 7 which is also conventional in the art.

Figure 7:
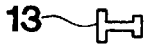
FIG. 7 is a side view of a rivet for connecting the lid and the tray.

Attached to the back wall 2 is a pair of pivot points 9 which can be made unitary with the tray or can be separate pieces which can be attached to the tray in any conventional manner. Each of the pivot points 9 has an aperture 10 extending therethrough, which will receive the rivets 13, shown in FIG. 7 in order to secure the lid, shown in FIG. 3 to the tray. The rivets will pass through the apertures 10 in the pivot points or projections 9 on the tray and through the apertures 10 on the pivot points or projections 9' on the lid in order to allow the lid to pivot with respect to the tray as the lid is moved from an open to a closed position. The rivet should be a loose fit between the the pivot points or projections 9, 9' so that the lid can be easily pivoted from an open to a closed position, or visa versa.

On the side wall of the roller tray are a pair of rubber snap locks 8 which are connected to the side wall by any conventional fastener 8'. The rubber snap locks 8 are pivotally secured to the fastener 8' by connecting pieces 18 which allow the snap blocks to pivot up and engage the projections 14 on the sides of the lid in order to lock the lid onto the tray. The paint roller tray can be made from any type of material such as, but not limited to, plastic or metal. In addition, the projections 14 can be formed in the side walls 15 of the lid by any conventional method.

The blocks 8 have an aperture 19 in at least one of its sides, and a second aperture 20 in the end of the block. The block 8 should be made from a rubber-like resilient material so it can snap over the projection 14. In the alternative, the block 8 can be made from a rigid material and the connecting piece 18 could be made from a resilient material.

In use, when the painter wants to stop painting and seal the paint left in the tray (and/or to seal the paint brush or roller in the tray), he/she pivots the lid 12 into a closed position. Then the user grabs the blocks 8 by the sides using the grooves or serrations 21 to get a better grip on the block 8, and pulls the block up until the projection 14 (which is angled away from the side of the lid 12) enters the aperture 19 in the side of the block 8. The user then allows the block 8 to be pulled toward the end or tip of the projection 14, which will be aided by the resiliency of the block 8, or the resiliency of the connecting piece 18, until the end or tip of the projection 14 enters the aperture 20. When both blocks 8 are secured to their respective projections 14, this will secure the lid 12 tightly to the tray 1.

Figure 3:
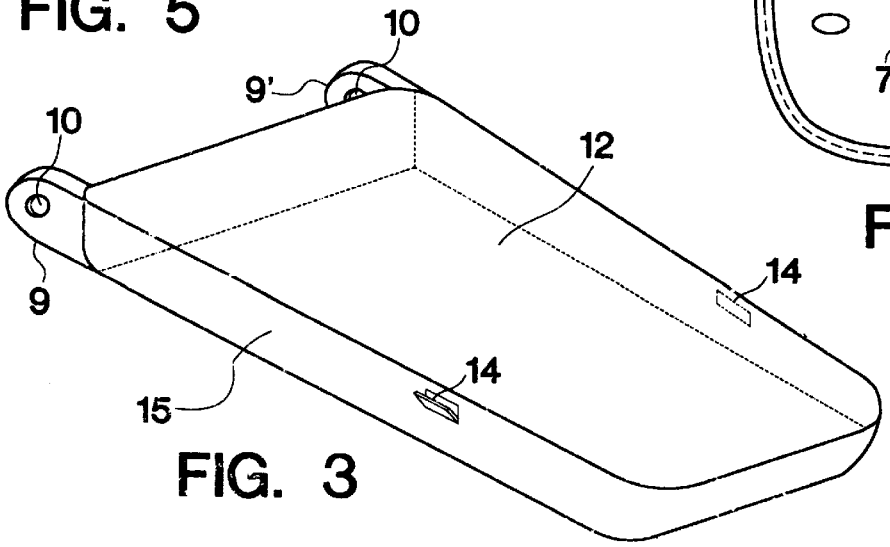
FIG. 3 is a perspective view of the lid used with the present invention.

FIG. 3 shows the lid 12 which will be secured to the paint roller tray. The lid 12 will be made from the same type of materials as the tray, however, if desired it could be made from a different material. For example, the tray could be made from metal and the lid made from plastic.

Figure 2:
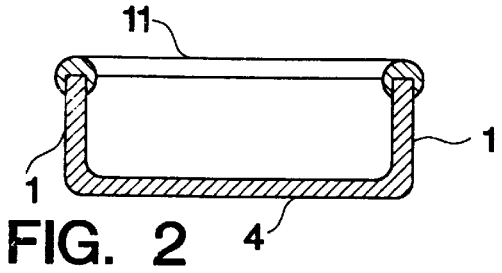
FIG. 2 is a cross-sectional view of the modified paint roller tray of the present invention.
Figure 4:
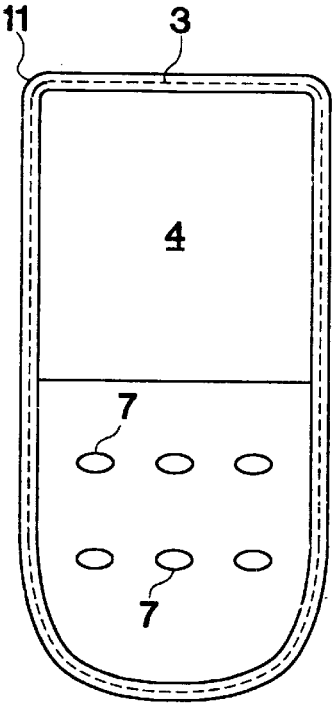
FIG. 4 is a top view showing the seal on the modified paint roller tray of the present invention.

As shown in FIGS. 2 and 4, a seal 11 is secured to the top of the roller tray. The seal 11 has a concave portion on its underside which will fit snugly over the top of the walls and sides of the tray. The seal 11 should be made from a resilient material such as plastic or rubber so it will form an air tight seal between the tray and the lid when the lid is closed and locked to the tray by means of the blocks 8 and the projections 14, as explained above.

Figure 5:
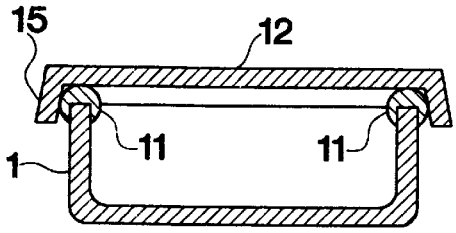
FIG. 5 is a cross-sectional view of the modified paint roller tray of the present invention with the lid and seal attached.

As shown in FIG. 3, the lid 12 has a depending side wall 15 which extends around three sides of the lid and will fit outside the walls and sides of the tray (see also FIG. 5). This allows the lid 12 to engage the seal 11 in two places, i.e. the top of the seal and on the sides of the seal, as clearly shown in FIG. 5. This will ensure that any unused paint that remains in the tray and/or any painting implements, such as a paint roller or brush that are in the tray, will be sealed in an air tight environment.

In use, when a painter wants to stop work for lunch or for the day, he/she will not have to remove the unused paint from the tray, put it in a paint can and seal the can. Also, when the painter wants to resume painting, he/she will not have to transfer paint from the paint can into the paint tray. Instead, when the painter wants to stop, he/she merely has to place any painting implements into the paint roller tray 1, pivot the lid 12 into place on the tray and snap the catches 8 onto the projections 14.

The seal 11 will prevent air from entering the tray and drying out the unused paint and/or painting implements. Then when the painter wants to resume painting, he/she will merely have to open the lid 12 and resume painting. This will save the painter time because he/she will not have to transfer paint from the paint can to the paint roller tray.

Although the Wet Paint and Roller Storage Unit and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A sealed paint roller tray and lid assembly comprising:

a paint roller tray having a bottom, front and back walls, sides and an open top, said sides and back wall having means for securing a lid thereto, a lid attached to said paint roller tray and said lid and said paint roller tray having cooperating catch means for sealingly securing said lid to said paint roller tray, seal means mounted on said front and back walls and said sides for sealing between said lid and said paint roller tray, and wherein said lid has a vertical wall extending from a top portion of said lid, said vertical wall extending outside of said front wall, back wall, and said sides of said paint roller tray when said lid is in a closed position, and said seal means engages an underside of said lid and an inside portion of said vertical wall when said lid is in a closed position.

2. The sealed paint roller tray and lid assembly as claimed in claim 1, wherein said seal means is secured to a top portion of said front wall, back wall, and said sides of said paint roller tray.

3. The sealed paint roller tray and lid assembly as claimed in claim 1, wherein said seal means has a concave portion on one side thereof, said concave portion engaging said front wall, back wall, and said sides of said paint roller tray.

4. The sealed paint roller tray and lid assembly as claimed in claim 1, wherein said catch means comprises at least one projection attached to said lid, and said paint roller tray has at least one snap lock depending therefrom, said snap lock engages said projection when said lid is closed in order to secure said lid to said tray.

5. The sealed paint roller tray and lid assembly as claimed in claim 4, wherein said projection is attached at an angle away from a side of said lid.

6. A sealed paint roller tray and lid assembly comprising:

a paint roller tray having a bottom, front and back walls, sides and an open top, said sides and back wall having means for securing a lid thereto, a lid attached to said paint roller tray and said lid and said paint roller tray having cooperating catch means for sealingly securing said lid to said paint roller tray, seal means mounted on said front and back walls and said sides for sealing between said lid and said paint roller tray, and wherein said catch means comprises at least one projection attached to said lid, and said paint roller tray has at least one snap lock depending therefrom, said snap lock engages said projection when said lid is closed in order to secure said lid to said tray, and wherein said snap lock is a block of resilient material and has a first aperture in a side and a second aperture in an end for receiving said projection.

7. A sealed paint roller tray and lid assembly comprising:

a paint roller tray having a bottom, front and back walls, sides and an open top, said sides and back wall having means for securing a lid thereto, a lid attached to said paint roller tray and said lid and said paint roller tray having cooperating catch means for sealingly securing said lid to said paint roller tray, seal means mounted on said front and back walls and said sides for sealing between said lid and said paint roller tray, and wherein said catch means comprises at least one projection attached to said lid, and said paint roller tray has at least one snap lock depending therefrom, said snap lock engages said projection when said lid is closed in order to secure said lid to said tray, and wherein said snap lock is a block of rigid material which is connected to said paint roller tray by a resilient material, and said block of rigid material has a first aperture in a side and a second aperture in an end.

* * * * *